United States Patent [19]

Landheer

[11] 4,292,779

[45] Oct. 6, 1981

[54] SUPPORTING SYSTEM FOR PANEL ASSEMBLY

[75] Inventor: Hugo A. J. Landheer, Rotterdam, Netherlands

[73] Assignee: Hunter Douglas International N.V., Netherlands

[21] Appl. No.: 14,712

[22] Filed: Feb. 23, 1979

[30] Foreign Application Priority Data

Feb. 24, 1978 [DE] Fed. Rep. of Germany ..... 2807942

[51] Int. Cl.[3] ..... E06B 3/54

[52] U.S. Cl. ..... 52/486; 52/487; 52/489; 52/544; 52/545

[58] Field of Search ..... 52/486, 487, 489, 763, 52/766, 768, 512, 544, 545, 547, 550, 713

[56] References Cited

U.S. PATENT DOCUMENTS

| | | | |
|---|---|---|---|
| 3,047,111 | 7/1962 | Clements | 52/545 |
| 3,266,209 | 8/1966 | Zibell | 52/487 |
| 3,553,915 | 1/1971 | Passovoy | 52/460 |
| 3,916,577 | 11/1975 | Vare | 52/489 |
| 4,102,105 | 7/1978 | Taylor | 52/544 |

*Primary Examiner*—Price C. Faw, Jr.
*Assistant Examiner*—Henry E. Raduazo
*Attorney, Agent, or Firm*—Pennie & Edmonds

[57] ABSTRACT

A panel assembly is disclosed as a covering for ceilings or walls comprised of a plurality of elongated panels (10) mounted to an underlying support member (13) by means of a two-part clamp (20, 21) comprising a generally hook-shaped securing member (21) and a locking member (20). The hook (30) of the securing member (21) engages behind a groove (12) along the edge of the panel and is mounted to the support (13) by means of the locking member (20) which engages behind an upstanding flange (18) on the support member (13). Each of the two parts (20, 21) of the clamp and the support member (13) have a uniform cross-section throughout their length to permit these parts to be extruded and cut to length.

11 Claims, 7 Drawing Figures

SUPPORTING SYSTEM FOR PANEL ASSEMBLY

BACKGROUND OF THE INVENTION

Panel assemblies for ceilings or walls are known which incorporate elongated panels which have their opposite longitudinal edges shaped to provide a tongue and groove arrangement, so that successive panels may be slip-fitted together with a tongue of one panel inserted in the cooperating complementary groove of an adjacent panel.

In many such panel assemblies, the panels are mounted upon an elongated supporting fixture which extends at an angle, usually transverse, to the length of the panels. Various attachment fixtures have been used for securing the panels to the underlying supports, and it is often necessary to have different fixtures depending upon the direction in which the panels are assembled. This required the stocking of a considerable number of different attachment fixtures for different applications and, frequently, mistakes could be made in selecting the wrong but quite similar attachment fixture for the particular application. Further, a considerable cost of the overall material is in the manufacture of these attachment fixtures themselves.

BRIEF DESCRIPTION OF THE INVENTION

The present invention is directed to overcoming the disadvantages experienced with existing supporting systems by providing a support, and a two-part clamp comprised of a securing member and a locking member, all of which have shapes suitable for formation by extrusion with subsequent cutting to the desired lengths. Further, the two-part clamps may be used in any orientation of the panels, thus eliminating the need to stock a variety of parts.

The underlying support has at least one flange along its length which extends upwardly from the support when the same is used to support panels with their length extending vertically. A securing member adapted to engage one edge of the panel on the exterior of its groove has a portion thereof designed to lie against the outer surface of the upwardly extending flange of the support member. A vertical opening through the securing member is designed to receive one leg of a generally U-shaped locking member, the other leg of which bears against the back surface of the upwardly extending flange of the support member.

The locking member has at the bottom of the leg inserted through the securing member a locking lip for cooperation in a snap-fit fashion with a locking lip provided on a second upstanding flange on the support member.

In one modification of the device, the locking member is modified to be useful with simple angle iron shape in which one leg of the U-shaped locking member is provided with a tapped hole for receipt of a screw which may be tightened against one flange of the underlying support member.

BRIEF DESCRIPTION OF THE DRAWINGS

The construction and operation of the device will be apparent to those skilled in the art from the following description and the accompanying drawings, in which.

DETAILED DESCRIPTION OF THE INVENTION

Figure 1:
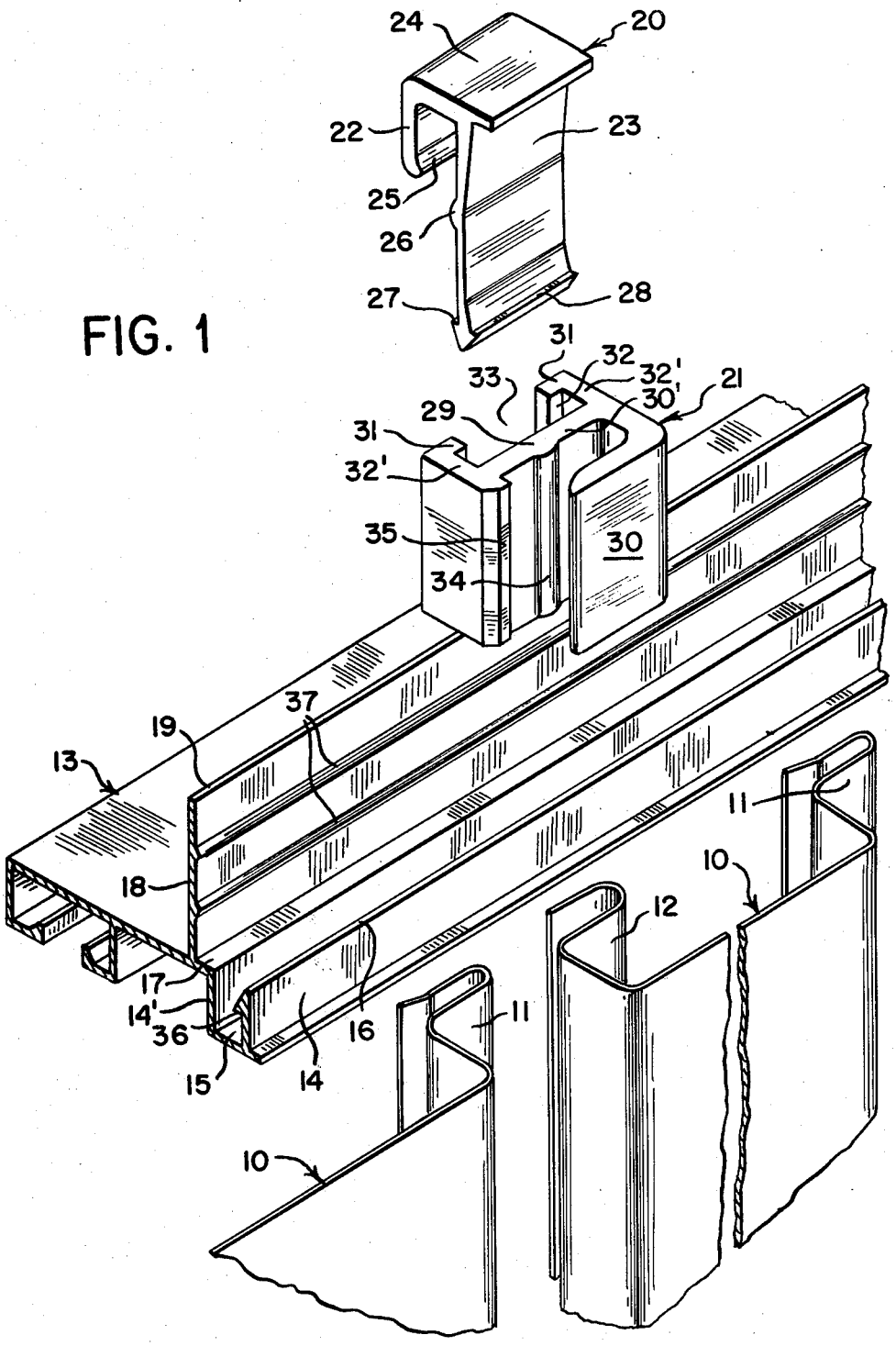
FIG. 1 is a perspective exploded view of one embodiment of the invention.

As shown in the drawings and as described herein, the panels are shown for assembly as a wall covering but it is to be understood that the same construction can be used for a ceiling. Terms such as upwardly, downwardly, outwardly and inwardly have reference to the various elements as they are utilized in assembling the panels as a wall finish and are not to be taken as limiting the structure claimed.

In the embodiment of FIGS. 1 through 6, the panel assembly comprises a plurality of elongated panels 10, each of which has along its opposite longitudinal sides a generally U-shaped cross-section with the cross-section of one edge being complementary to the shape of the opposite edge. A generally U-shaped tongue 11 is provided along one edge and shaped and dimensioned to be received within the generally U-shaped groove contour 12. The shapes and dimensions of the tongue 11 and groove 12 are such that the tongue 11 will slip fit snugly within the groove 12 in the manner shown in FIG. 6.

An elongated support 13 has a cross-section suitable for extrusion and may be cut to any desired length, generally several feet long. In cross-section, the support member 13 includes a channel 15 defined by a front wall 14 and rearward wall 14'. The support member 13 also includes an upstanding flange 18 which extends throughout its length with the bottom of the flange 18 being integral with a web 17 which connects the flange 18 to the upper end of the wall 14' with which the web 17 is also integral. The shape of the support member 13 to the left (as viewed in FIGS. 1, 2 and 3) of the flange 18 may be any shape desired depending upon what basic structure the support is to be mounted to. The inverted U-shaped channel shown to the left of the flange 18 in the figures is shown merely as one of a myriad of possibilities.

The front wall 14 of the channel 15 has a free longitudinal edge 16 at approximately the same distance from the bottom of the channel 15 as the web 17.

A two-part clamp is provided comprising a locking member 20 and a securing member 21. The locking member 20 has two locking legs 22 and 23 which are approximately parallel to each other and are joined together by a web 24 which extends approximately perpendicular to the plane of the face of the panels 10. The locking leg 22 is shorter than locking leg 23 and has an inwardly projecting bead 25 along its lower edge. Locking leg 23 has a bead 26 located intermediate its length. The free lower edge of the locking leg 23 has a generally arrow-shape cross-section providing two projecting lips 27 and 28, which like beads 22 and 23 extend throughout the entire length of the locking element 20. It will be apparent that the shape of the locking element 20 is such as to be readily extruded and cut to length.

The securing member 21 includes a hook 30 integral with a central web 29. The central web 29 has a bead 34 located centrally thereof and a locking lug 35 for purposes which will hereinafter be apparent. Two walls 32' extend rearwardly from the web 29 and terminate in inwardly extending flanges 31. The web 29, walls 32' and flanges 31 define a passage 32 for receipt of the leg 23 of the locking member 20 as more fully described hereinafter. In the embodiment shown in FIGS. 1 through 6, the walls 31 project toward each other, thus defining therebetween a slot 33. However, if desired the walls 31 may meet and be integral with each other, in which event there will be no slot 33. In the embodiment shown, which incorporates the slot 33, the structure of the securing element 21 is thoroughly sufficient and strong for the purpose while at the same time conserving material by eliminating it in the area of the slot 33.

ASSEMBLY

Figure 2:
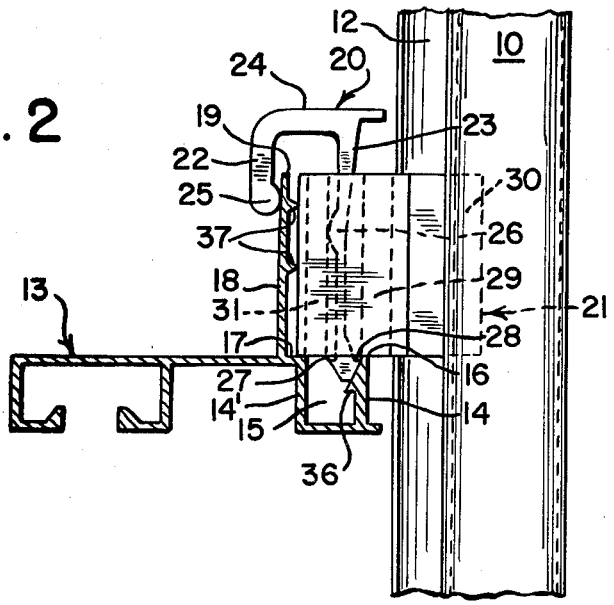
FIG. 2 is a somewhat diagrammatic view of one longitudinal edge of one panel during assembly with the locking element only partially assembled.
Figure 3:
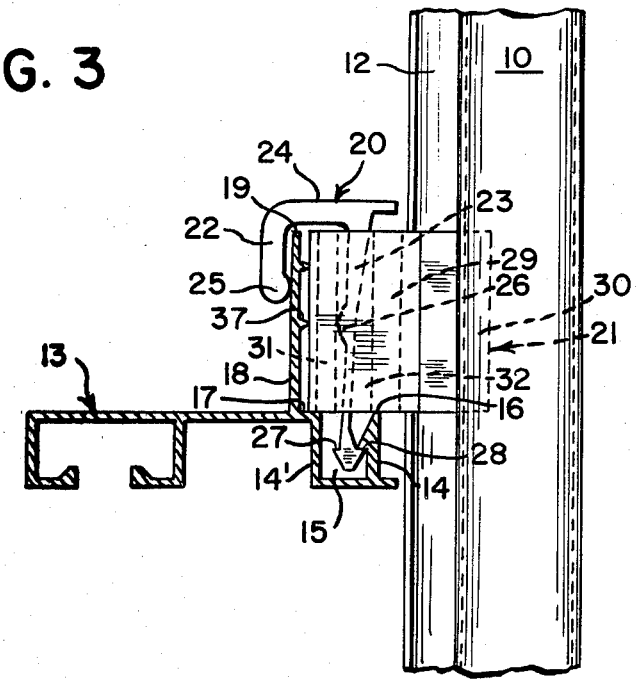
FIG. 3 is a view corresponding to FIG. 2 but with the locking element fully inserted.
Figure 5:
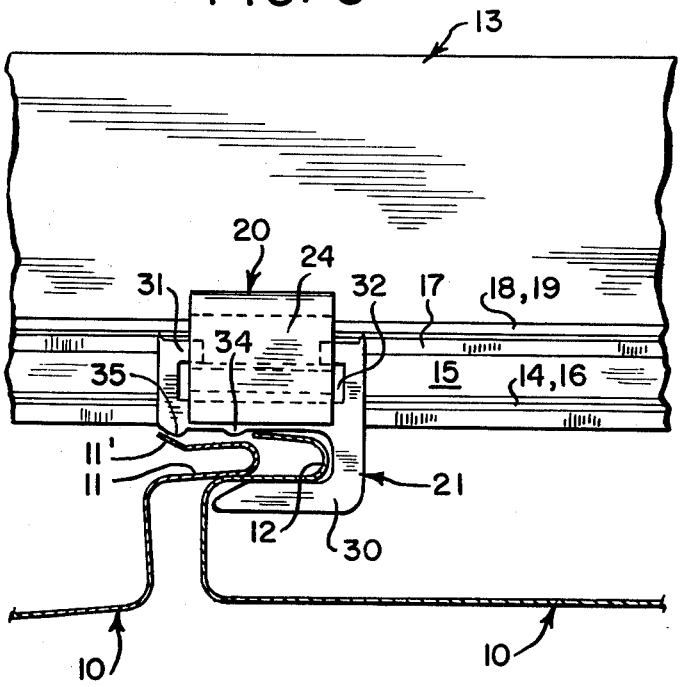
FIG. 5 is a view looking at the end of a panel showing the manner of insertion of a second panel during assembly.

To assemble the panels to the support structure 13 which is already fixed, leg 23 of the locking member 20 is first inserted downwardly into the passage 32 of the securing member 21 until the locking lip 27 which is on the lower free end of the leg 23 has engaged under the lower edge of the walls 31. The dimensions and shape of the passage 32 and the leg 23 are such that there is a detent or snap action with a slight distortion of the leg 23. In this way, an involuntary separation of the locking element 20 from the securing member 21 is avoided. A first panel 10 is then brought into the correct position relative to the support 13 and the securing element 21 hooked around the grooved edge 12. This, again, is a snap fit and the edge of the free arm of the groove 12 comes to lie behind the bead 34 as shown in FIG. 5. The securing member is then brought into position such that it rests on the longitudinal edge 16 of the front wall 14 of the support member 13 and also on the web 17 as shown in FIGS. 2 and 3. In this position, the locking element 20 is not fully in position but leg 22 has engaged behind the free longitudinal edge 19 of the flange 18.

The locking member 20 is then pressed downwardly further with respect to the passage 32 of the securing member 21 until it reaches the position shown in FIG. 3. As shown in FIG. 3, the locking lip 28 has engaged beneath a cooperating locking lip 36 projecting inwardly of the channel 15 from the wall 14. Also, the bead 26 of the locking leg 23 bears against the inside of the walls 31 so that there is a slight elastic deformation of the leg 23, thus maintaining the locking lip 28 and the locking lip 36 in their engaged and locked position. At the same time, a clamping action is also exerted between locking legs 22 and 23 in such a way that the outer surface of the walls 31 are pressed against longitudinally extending ribs 37 on the flange 18 with the bead 25 of the locking leg 22 bearing with an elastic spring action against the rear side of the flange 18. This cooperative relationship brings such pressure to bear as to slightly deform ribs 37, thus further insuring that the parts do not become dislodged.

Figure 4:
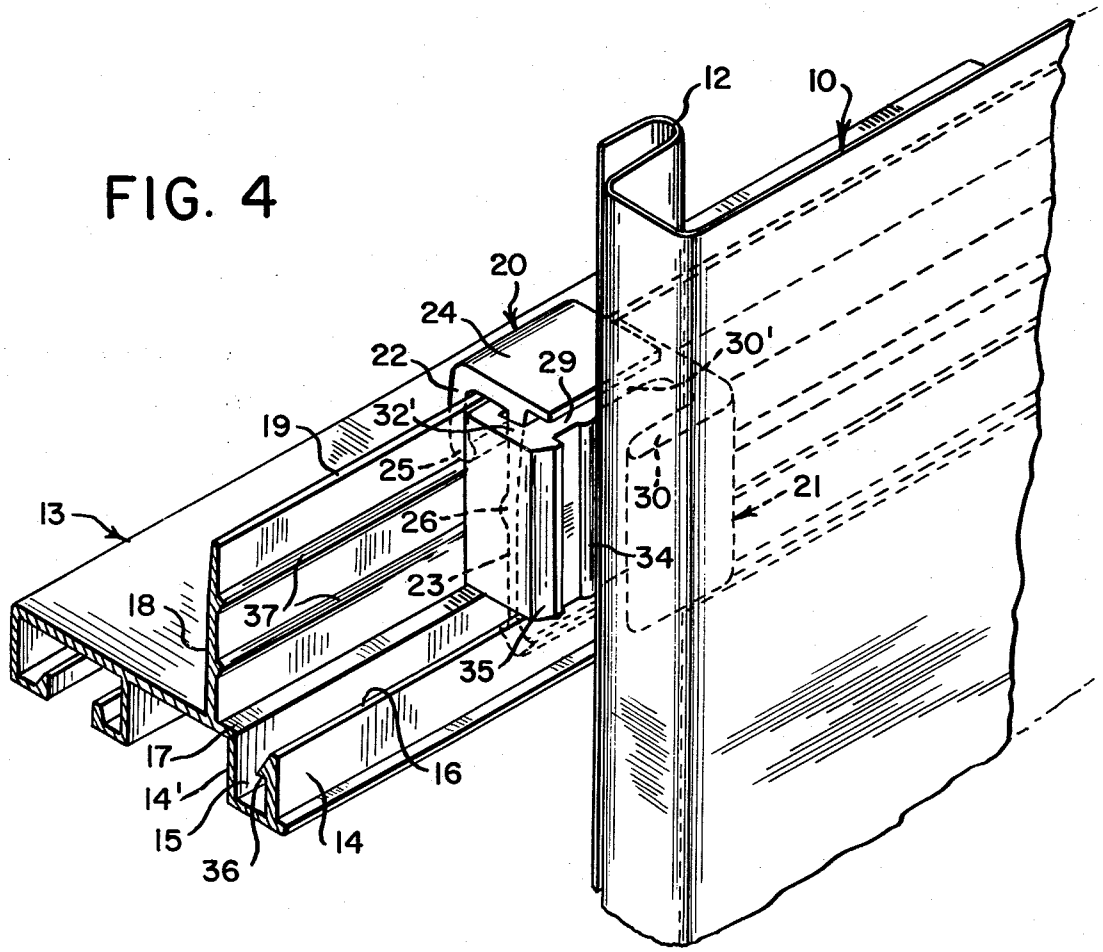
FIG. 4 is a perspective view taken after the assembly of a panel.
Figure 6:
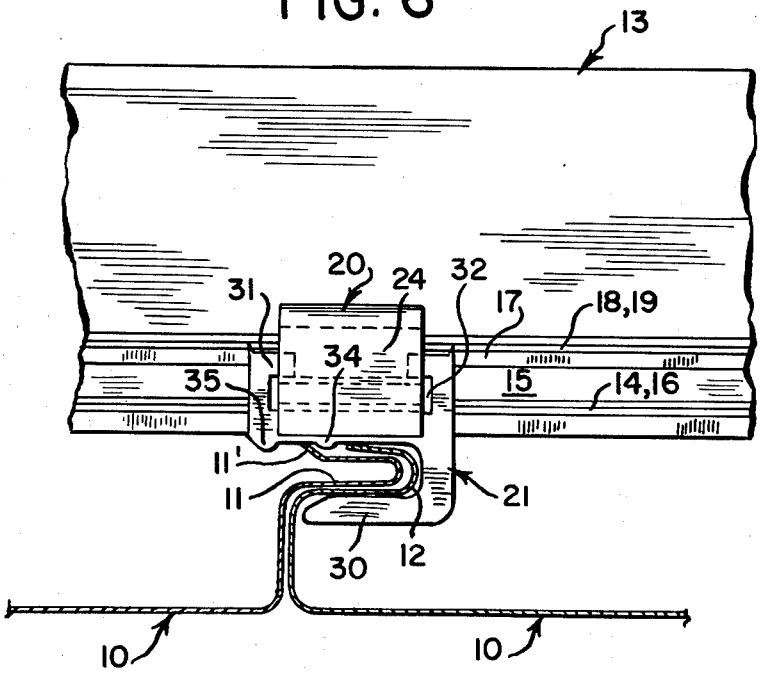
FIG. 6 is a view like FIG. 5 but showing the second panel after completion of assembly.

At this point, the parts are in the position shown in FIGS. 3 and 4, and a second panel 10 may now be assembled. Having reference to FIGS. 5 and 6, the U-shaped tongue 11 of panel 10 is now slip-fitted within the groove 12, as shown. The terminus 11' of the tongue 11 is bent off at an angle away from the face of the panels 10, and when the tongue 11 has been fully inserted, this terminus 11' engages behind the locking lug 35, as shown in FIG. 6, and bears against the web 29 in the area between the locking lug 35 and the bead 34. In this position, the lug 35 effectively prevents any involuntary removal of the tongue from the groove.

As mentioned, the support member 13, locking member 20 and securing member 21 each have such a cross-section as to be suitable for extrusion after which they may be cut to any desired length. The same is also true of the embodiment shown in FIG. 7.

MODIFIED EMBODIMENT

Figure 7:
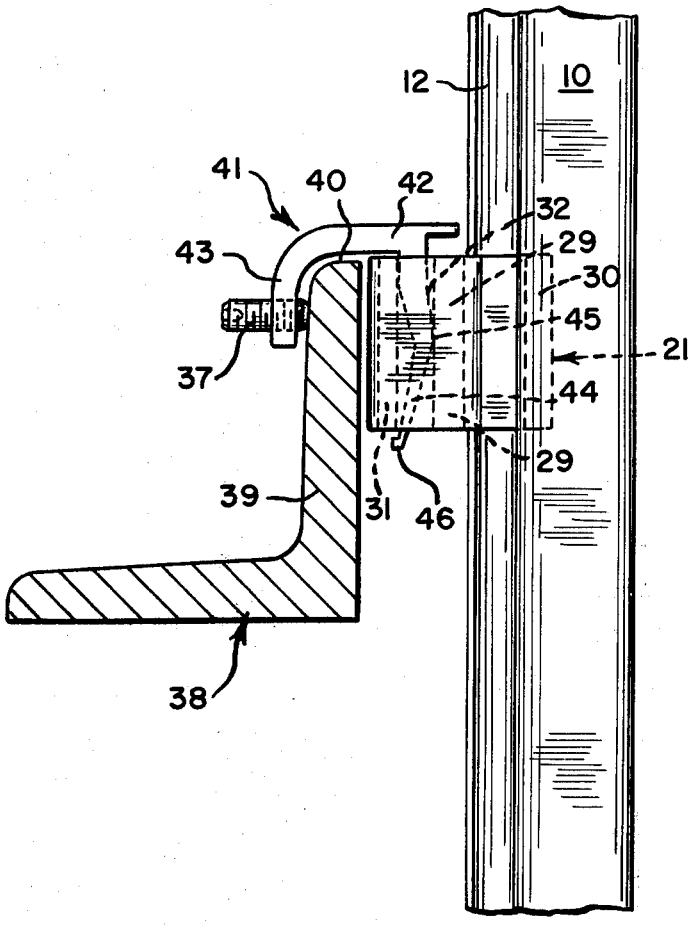
FIG. 7 is a somewhat diagrammatic view similar to FIG. 3 showing a modified embodiment of the invention.

FIG. 7 shows a modification of the two-part clamp in which the locking member has been modified in order to adapt the clamp for use with a common angle iron shape. Such shapes are universally and economically available and it may be desired to use the same rather than the specific support member 13 previously described. The securing member 21, as shown in FIG. 7, is identical to that shown in the embodiment of FIGS. 1 through 6 and in FIG. 7 like elements have the same reference numerals as in FIGS. 1 through 6.

The support member 38 has a vertical flange 39 with an upper free longitudinal edge 40 for cooperation with locking member 41.

Locking member 41 comprises a central web 42 extending substantially transverse to the plane of the panels 10 and includes two locking legs 43 and 44. The locking leg 43 engages across the free longitudinal edge 40 of the support member 38. The locking leg 44 has a slightly bent cross-section as shown with the lower portion arranged at an angle to the upper portion, thus providing a bearing edge 45 which bears against the central web 29 of the securing member 21. On its lower edge, the locking leg 44 has a locking lip 46 which engages under the lower edge of the walls 31 of the securing member 21. This engagement of the locking lip 46 beneath the lower edge of the walls 31 is a resilient snap action resulting from the flexing of the locking leg 44 due to the bearing edge 45 bearing against the web 29.

When a panel 10 and securing member 21 together with the locking member 41 have been brought into the position shown in FIG. 7, final securement is achieved by tightening a set screw 37 threaded into a tapped hole in locking leg 42.

In the above description, only one two-part clamp has been shown and described for each of the two embodiments; however, it will be appreciated that two or more clamps will be used at each junction between two panels.

What is claimed is:

1. In a panel assembly having a plurality of elongated panels, the improvement comprising a support member including a flange lying in a plane parallel to and spaced rearwardly of the plane of the panels, a two part clamp, having a first part to engage a panel edge and a second part to engage the first part as well as said support member, said first clamp part being a securing member having a hook portion, a passage extending through said securing member, said second clamp part being a locking member having two locking legs, the hook of said securing member being engaged with one longitudinal edge of a panel on the rearward side thereof, one of said locking legs extending through the passage in said securing member, and the other of said locking legs being in bearing engagement with said flange; and the crossmember being uniform throughout its length, whereby each forms a cut-to-length part of an extruded profile.

2. The panel assembly of claim 1, in which said support member includes a second flange arranged in a plane parallel to and spaced behind said elongated panels, said one locking leg being engaged with said flange.

3. The panel assembly according to claim 2, in which said support member includes a channel member having two spaced parallel walls, said second flange being one of said walls, and said securing member resting upon the upper edges of said channel walls.

4. The panel assembly according to claim 3, in which said locking member is resilient and is snap fitted into position, and said locking member resiliently urging said securing member against said first mentioned flange.

5. The panel assembly according to any one of claims 2, 3 or 4, in which said second flange has a locking lip, said first locking leg also having a locking lip in locking engagement with the locking lip of said second flange.

6. The panel assembly according to claim 1, in which the longitudnal edge of said panel engaged by said hook defines a groove seated in said hook.

7. The panel assembly according to claim 6, in which said hook includes a bead, and said groove having a free edge being retained against inadvertent disassembly by said bead.

8. The panel assembly according to claim 7, in which each of said panels has a tongue-shaped member along the longitudinal edge thereof opposite to said one longitudinal edge, and said tongue being diminisioned to slip fit within said groove.

9. The panel assembly according to claim 8, in which said tongue member has an off-set portion extending from said tongue away from the face of said panel, said securing member including a locking lug, and said off-set portion of said tongue being engaged with said locking lug.

10. The panel assembly according to claim 9, in which said other locking leg has a bead at its point of bearing engagement with said first flange.

11. The panel assembly according to claim 1, in which said other locking leg includes a set screw providing the bearing engagement with said flange.

* * * * *

UNITED STATES PATENT AND TRADEMARK OFFICE

CERTIFICATE OF CORRECTION

PATENT NO. : 4,292,779

DATED : October 6, 1981

INVENTOR(S) : Hugo A. J. Landheer

It is certified that error appears in the above-identified patent and that said Letters Patent are hereby corrected as shown below:

Title Page :

[73] "Assignee: Hunter Douglas International N.V., Netherlands" should read --Assignee: Hunter Douglas International N.V., Curacao, Netherlands Antilles--

Signed and Sealed this

Sixteenth Day of March 1982

[SEAL]

Attest:

GERALD J. MOSSINGHOFF

Attesting Officer

Commissioner of Patents and Trademarks